US006159314A

United States Patent [19]

Koizumi et al.

[11] Patent Number: 6,159,314

[45] Date of Patent: Dec. 12, 2000

[54] NICKEL-BASE SINGLE-CRYSTAL SUPERALLOYS, METHOD FOR MANUFACTURING THE SAME, AND GAS TURBINE PARTS PREPARED THEREFROM

[75] Inventors: Yutaka Koizumi; Toshiharu Kobayashi, both of Ryugasaki; Shizuo Nakazawa; Hiroshi Harada, both of Tsukuba; Tosihiro Yamagata, Yokohama; Takehisa Hino, Yokohama; Yomei Yoshioka, Yokohama, all of Japan

[73] Assignees: Kabushiki Kaisha Toshiba, Kawasaki; National Research Institute for Metals, Tsukuba, both of Japan

[21] Appl. No.: 09/261,230

[22] Filed: Mar. 3, 1999

[30] Foreign Application Priority Data

Mar. 4, 1998 [JP] Japan ..... 10-067671

[51] Int. Cl.[7] ..... C22F 1/10

[52] U.S. Cl. ..... 148/555; 148/675; 148/428; 420/448

[58] Field of Search ..... 148/428, 555, 148/675; 420/448

[56] References Cited

U.S. PATENT DOCUMENTS

| | | | |
|---|---|---|---|
| 4,388,124 | 6/1983 | Henry | 148/404 |
| 4,643,782 | 2/1987 | Harris et al. . | |
| 4,719,080 | 1/1988 | Duhl et al. . | |
| 5,100,484 | 3/1992 | Wukusick et al. | 420/448 |
| 5,240,518 | 8/1993 | Wortman et al. | 148/428 |
| 5,660,649 | 8/1997 | Bornstein et al. | 148/404 |
| 5,820,700 | 10/1998 | DeLuca | 148/410 |

FOREIGN PATENT DOCUMENTS 5-59474 3/1993 Japan .

*Primary Examiner*—John Sheehan
*Assistant Examiner*—Andrew L. Oltmans
*Attorney, Agent, or Firm*—Oblon, Spivak, McClelland, Maier & Neustadt, P.C.

[57] ABSTRACT

The invention relates to a nickel-base single-crystal superalloy applied to parts for industrial gas turbine or the like such as turbine rotor blade and stator blade which are used at high temperatures, a method for manufacturing the same, and gas turbine parts prepared from such nickel-base single-crystal superalloys, and more particularly the invention provides a nickel-base single-crystal superalloy consisting essentially of, in percentages by weight, 5% to 10% cobalt, 4.7% to 6% chromium, more than 2.0% to less than 3.5% molybdenum, 7.5% to 10% tungsten, 5% to 6% aluminum, 0.1% to 2% titanium, 4% to 5.5% tantalum, 1% to 4% rhenium, 0.01% to 0.2% hafnium, the balance being nickel and incidental impurities, which is excellent in high-temperature strength and high-temperature corrosion resistance, and further excellent in structural stability even in a long time use.

6 Claims, 4 Drawing Sheets

$$LMP = T(20+\log(tr)) \times 10^{-3}$$

T: TEMPERATURE, K tr: RUPTURE LIFE, h

NICKEL-BASE SINGLE-CRYSTAL SUPERALLOYS, METHOD FOR MANUFACTURING THE SAME, AND GAS TURBINE PARTS PREPARED THEREFROM

BACKGROUND OF THE INVENTION

1. Field of the Invention

The present invention relates to nickel-base single-crystal superalloys applied to parts for industrial high temperature gas turbine, such as turbine rotor blade and stator blade, a method for manufacturing the same, and gas turbine parts prepared therefrom.

2. Description of the Related Art

With a trend towards high efficiency of gas turbine, combustion temperature therefor rises, so that turbine rotor and stator blades have changed from a type of ordinary cast blade to a type of unidirectional solidified blade wherein crystal grain boundary along the stress axial direction is removed to improve creep strength at high temperatures, and further to a type of single-crystal blade wherein grain boundary reinforcing elements the presence of which is a cause for decreasing heat treatment characteristics are excluded by allowing crystal grain boundary to disappear, so that the optimum heat treatment is applied to elevate a ratio of deposition of γ', whereby creep strength at high temperatures are more improved.

On the other hand, materials applied to single-crystal blade have been improving in creep strength.

A first generation single-crystal alloys contain no Re (Renium). As an example of such alloys, Japanese Patent Application Laid-Open No.19032/1984 discloses CMSX-2. U.S. Pat. No. 5,399,313 discloses Rene' N4. Japanese Patent Application Laid-Open No.146223/1978 discloses PWA-1480.

Second generation single-crystal alloys contains around 3% of Re, and so its creep rupture strength is about 30° C. better than that of the first generation single-crystal alloys. As an example of second generation single-crystal alloys, U.S. Pat. No. 4,643,782 discloses CMSX-4. U.S. Pat. No. 4,719,080 discloses PWA-1484, and Japanese Patent Application Laid-Open No. 59474/1993 discloses Rene' N5.

Furthermore, third generation single-crystal alloys contain around 5% to 6% of Re, and as an example of such alloys, CMSX-10 is disclosed in Japanese Patent Application Laid-Open No. 138683/1995.

Although these single-crystal alloys have been developed remarkably in mainly fields of aircraft jet engines and small gas turbines, it has been intended to convert such technology therefor into also a field of large gas turbines for industrial use because of achieving high temperatures directing to improvements in combustion efficiency.

When a third generation single-crystal alloy is applied, high temperature strength can be obtained, while there rises a disadvantage of poor structural stability. Particularly, since an industrial large gas turbine takes longer time for design life as compared with aircraft jet engine or small gas turbine, it is required as to blade materials to inhibit formation of TCP (Topoligically Close-Packed) phase, i.e., to attain good structural stability. Therefore, it is not suitable to apply such a third generation single-crystal alloy to a large gas turbine.

For example, by adding further 5% to 6% of Re, a third generation single-crystal alloy can achieve a higher strength than that of a second generation single-crystal alloy. However, when such a third generation single-crystal alloy is adopted for a long period of time, TCP phase which becomes a starting point of low cycle rupture is produced, so that creep rupture arises, because such a third generation alloy is added 5% to 6% of Re.

In addition, Re decreases a casting yield in case of manufacturing a large gas turbine due to reaction with its casting mold, and it deteriorates also heat treatment characteristics due to segregation. In these circumstances, a reacting area with a casting mold increases, and its heat treatment is required for a long period of time in gas turbine for industrial use wherein a blade dimension becomes larger than that of aircraft gas turbine.

Therefore, nickel-base superalloys containing around 3% of Re, that is, a second generation single-crystal alloys, is studied as a material of gas turbine rotor and stator for large generator at present. And so, it is desirable that gas turbine is improved in creep strength, because of need for much higher combustion temperature.

In comparison with the characteristic property required for next generation gas turbine rotor and stator blades, second generation single-crystal alloy exhibits usually a sufficient creep strength at a temperature of 900° C. or lower and in a stress of 200 MPa or more, while there is a problem of an insufficient creep strength at a high temperature of more than 900° C. and in a stress of less than 200 MPa.

SUMMARY OF THE INVENTION

Accordingly, the present invention has been made to solve the problems as described above, and an object of the invention is to provide a single-crystal alloy which has an equal or higher creep strength to or than that of the second generation single-crystal alloy at a temperature of 900° C. or less and in a stress of 200 MPa or more, and has a higher creep strength than that of the second single-crystal alloy at a high temperature of more than 900° C. and in a stress of less than 200 MPa, besides which is excellent in structural stability.

Another object of the invention is to provide a method for manufacturing the single-crystal alloy as described above.

A further object of the invention is to provide gas turbine parts prepared from the single-crystal alloy as described above.

These and other objects can be achieved by providing a first aspect of the present invention, a nickel-base single-crystal superalloy consists essentially of, in percentages by weight, 5% to 10% cobalt, 4.7% to 6% chromium, more than 2.0% to less than 3.5% molybdenum, 7.5% to 10% tungsten, 5% to 6% aluminum, 0.1% to 2% titanium, 4% to 5.5% tantalum, 1% to 4% rhenium, 0.01% to 0.2% hafnium, the balance being nickel and incidental impurities.

According to this aspect of the invention in a preferred embodiment, a nickel-base single-crystal superalloy, consists essentially of, in percentages by weight, 6% to 9% cobalt, 4.9% to 5.5% chromium, 2.5% to 3.5% molybdenum, 8% to 9.5% tungsten, 5.1% to 5.5% aluminum, 0.1% to 1% titanium, 4% to 5% tantalum, 2% to 3.5% rhenium, 0.01% to 0.2% hafnium, the balance being nickel and incidental impurities.

According to the second aspect, a method for manufacturing a nickel-base single-crystal superalloy, the method comprises the steps of: preparing raw materials containing nickel, cobalt, chromium, molybdenum, tungsten, aluminum, titanium, tantalum, rhenium and hafnium; melting and cooling the raw materials to form a nickel-base single-crystal superalloy element material; quenching the superalloy element material rapidly; subjecting the quenched superalloy element material to solution heat treatment within a temperature range of from 1210° C. to 1350° C. under a condition of a vacuum or inert atmosphere; quenching the superalloy element material rapidly; subjecting the quenched superalloy element material to first ageing annealing treatment within a temperature range of from 1100° C. to 1200° C.; quenching the superalloy element material rapidly; and subjecting the quenched superalloy element material to second ageing annealing treatment within a temperature range lower than that of the first ageing annealing treatment.

According to this aspect of the invention, in a preferred embodiment is a method for manufacturing a nickel-base single-crystal superalloy wherein the nickel-base single-crystal superalloy consists essentially of 5% to 10% cobalt, 4.7% to 6% chromium, more than 2.0% to less than 3.5% molybdenum, 7.5% to 10% tungsten, 5% to 6% aluminum, 0.1% to 2% titanium, 4% to 5.5% tantalum, 1% to 4% rhenium, 0.01% to 0.2% hafnium, the balance being nickel and incidental impurities.

According to this aspect of the invention, in a preferred embodiment is a method for manufacturing a nickel-base single-crystal superalloy wherein the nickel-base single-crystal superalloy consists essentially of 6% to 9% cobalt, 4.9% to 5.5% chromium, 2.5% to 3.5% molybdenum, 8% to 9.5% tungsten, 5.1% to 5.5% aluminum, 0.1% to 1% titanium, 4% to 5% tantalum, 2% to 3.5% rhenium, 0.01% to 0.2% hafnium, the balance being nickel and incidental impurities.

According to this aspect of the invention, in a preferred embodiment is a method for manufacturing a nickel-base single-crystal superalloy wherein the solution heat treatment is carried out within a period of time of 10 hours and the ageing annealing treatment is carried out within a period of time of 30 hours.

According to this aspect of the invention, in a preferred embodiment is a method for manufacturing a nickel-base single-crystal superalloy wherein the solution heat treatment is carried out in accordance with any of temperature changes extending from two- to four-stages and the ageing annealing treatment is carried out in accordance with one- and two-stage temperature changes.

According to this aspect of the invention, in a preferred embodiment is a method for manufacturing a nickel-base single-crystal superalloy wherein a preliminary heat treatment is carried out at a temperature by 20° C. to 60° C. lower than that of the solution heat treatment within 2 hours prior to the solution heat treatment.

According to another aspect, gas turbine parts is constituted by a material made from the nickel-base single-crystal superalloy consisting essentially of, in percentages by weight, 5% to 10% cobalt, 4.7% to 6% chromium, more than 2.0% to less than 3.5% molybdenum, 7.5% to 10% tungsten, 5% to 6% aluminum, 0.1% to 2% titanium, 4% to 5.5% tantalum, 1% to 4% rhenium, 0.01% to 0.2% hafnium, the balance being nickel and incidental impurities.

According to this aspect of the invention in a preferred embodiment, gas turbine parts is constituted by a material made from the nickel-base single-crystal superalloy consisting essentially of, in percentages by weight, 6% to 9% cobalt, 4.9% to 5.5% chromium, 2.5% to 3.5% molybdenum, 8% to 9.5% tungsten, 5.1% to 5.5% aluminum, 0.1% to 1% titanium, 4% to 5% tantalum, 2% to 3.5% rhenium, 0.01% to 0.2% hafnium, the balance being nickel and incidental impurities According to this aspect of the invention in a preferred embodiment, gas turbine parts are prepared from the nickel-base single-crystal superalloy manufactured in accordance with the manufacturing method according to the second aspect discussed above.

Advantageous effects of each element in the compositions of alloy as well as reasons for restricting the compositions in the first and second aspects will be described hereinafter.

Co (cobalt) is an element which replaces nickel in γ-phase to reinforce the matrix in solid solution. Furthermore, Co is an element having such an effect for broadening a temperature range for making solution by lowering the solution temperature of γ', whereby the heat treatment characteristics are improved. The reason for defining that a content of Co ranges from 5% to 10% in percentages by weight in the present invention is in that when a content of Co is less than 5%, a range of temperature for making solution is narrowed, while when more than 10% of Co is added, γ' amount decreases and creep strength reduces. A more preferable content of Co is from 6% to 9% in percentages by weight.

Cr (chromium) is an element for improving high-temperature corrosion resistance. When an amount of Co is less than 4.7%, a desirable high-temperature corrosion resistance cannot be maintained, while when an amount of Co is more than 6%, TCP phases of Re—Cr—W, Cr—W, and Cr—Mo and the like are produced. Thereby, it is specified that an amount of Cr is from 4.7% to 6% in percentages by weight. A more preferable amount of Cr ranges from 4.9% to 5.5% in percentages by weight.

Mo (molybdenum) is an element for reinforcing γ-phase to make solution. Moreover, Mo is an element for accelerating raft effect being a reinforcing mechanism at high temperatures for making γ/γ' misfit negative. In the present invention, it is specified that an amount of Mo to be added is from more than 2.0% to 3.5% or less in percentages by weight. It is necessary to contain at least 2% of Mo for obtaining required creep strength, while when an amount of Mo to be added exceeds 3.5%, production of TCP phases of α-Mo, Re—Mo and the like is accelerated. A more preferable amount of Mo to be added is from 2.5% to 3.5%.

W (tungsten) is an element for reinforcing γ-phase to make solution. In the present invention, the reason for defining that a content of W is from 7.5% to 10% in percentages by weight is in that at least 7.5% of W is necessary for obtaining required creep strength. On the other hand, when addition of Mo is more than 10%, TCP phases of α-W, Cr—Re—W, Re—W and the like are produced, and it results in deterioration of strength. A more preferable content of W ranges from 8% to 9.5%.

Al (aluminum) is an element for forming γ'-phase being a major reinforcing factor of nickel-base deposition reinforcing type alloys, while Al is an element which contributes also to improvements in oxidation resistance as a result of forming Al oxide on the surface thereof. In the present invention, it is specified that an amount of Al to be added is from 5% to 6% in percentages by weight. The reason is in that at least 5% of Al to be added is necessary for attaining required creep characteristics, while when an amount of Al exceeds 6%, a large amount of eutectic γ' is produced, whereby solution heat treatment becomes difficult. A more preferable amount of Al to be added ranges from 5.1% to 5.5%.

Ti (titanium) is an element which is replaced by Al in γ' phase to form $Ni_3(Al, Ti)$, thereby serving for reinforcement of the γ'-phase to make solution. In the present invention, the reason for defining that a content of Ti is 0.1% to 2% in percentages by weight is in that excessive addition of Ti accelerates production of eutectic γ'-phase or deposition of $Ni_3Ti$ phase (η-phase), and as a result, creep breaking strength is deteriorated. Furthermore, when a resulting alloy is barely used for a long period of time, a Ti nitride is produced immediately under the surface of the alloy, and low cycle fatigue characteristics are adversely affected by the Ti nitride thus produced. A more preferable content of Ti ranges from 0.1% to 1%.

Ta (tantalum) is an element for reinforcing γ'-phase as a result of making solution with γ'-phase principally, besides Ta is an element contributing to oxidation resistance. In the present invention, the reason for specifying that an amount of Ta to be added is 4% to 5.5% is in that addition of at least 4% is necessary for achieving a required creep strength, while when an amount of Ta exceeds 5.5%, it accelerates production of eutectic γ'-phase, whereby the heat treatment in solution heat treatment becomes difficult. A more preferable amount of Ta to be added is from 4% to 5%.

Re (rhenium) is an element for reinforcing γ-phase to make solution. In the present invention, the reason for specifying an amount of Re to be added ranges from 1% to 4% in percentages by weight is in that addition of at least 4% of Re is necessary for achieving a required creep strength. Addition of Re in an amount of more than 4% accelerates production of TCP phases of Re—Mo, Re—W, Re—Cr—W and the like, besides it results in a narrower temperature range of solution. A more preferable amount of Re to be added is from 2% to 3.5%.

Hf (hafnium) is an element for reinforcing grain boundary of various crystals, such as zebragraincrystal, frecklecrystal and the like, produced at the time of casting single-crystal turbine rotor and stator blades or that of recrystal produced by the following heat treatment and working therefor. Besides Hf is an element for improving a yield of turbine rotor and stator blades. In the present invention, the reason for specifying that an amount of Hf to be added is from 0.01% to 0.2% is in that addition of Hf in an amount of more than 0.2% decreases melting point of a resulting alloy and deteriorates heat treatment characteristics thereof. On the other hand, when an amount of Hf to be added is less than 0.01%, the foregoing advantageous effects cannot be obtained.

V (vanadium) and Nb (niobium) being the trace elements to be added other than those described above may be added singly or in combination with them in an amount of up to 0.5%, respectively, for elevating a strength of the resulting alloy.

According to the present invention, this alloy is strengthened by depositing γ'-phase in principally nickel matrix. More specifically, creep strength at high temperatures is the highest in the case where γ'-phases each of which is in a cubic form and has a size of around 0.2 μm to 0.6 μm disperse uniformly into nickel matrix. For this reason, it is required that the γ'-phases each having an ununiform shape separated out at the time of casting have been once solid-solved into nickel matrix, and then these γ'-phases are deposited again into the ones each of which exhibits a cubic form and has a size of around 0.2 μm to 0.6 μm. In order to achieve the process described above, the alloy is subjected to solution heat treatment in accordance with a manner wherein the alloy is heated at a temperature which is equal to or higher than a dissolution temperature of γ'-phase, whereby the γ'-phase is dissolved into nickel matrix. In this respect, a dissolution temperature immediately below that of nickel matrix is effective from industrial point of view. This is because a less period of time is required for uniformalizing solid solution and composition of an alloy. On the other hand, recrystallization occur in heat treatment at high temperatures due to machine work of a blade embedded portion in case of working the alloy into turbine rotor and stator blades and mechanical strain arising in the event of blast working wherein a surface part of the blade is cleaned in case of applying coating process, and as a result, creep strength decreases. For this reason, it is required to apply heat treatment at the highest temperature at which there occurs no recrystallization. However, since a degree of mechanical strain introduced differs from one another dependent upon types of coating used, and manners for working, the lower limit of solubilization temperature is defined as 1210° C. at which the creep strength higher than that of a second generation single-crystal alloy is attained. Furthermore, when a temperature exceeds 1350° C. in the alloy according to the present invention, nickel matrix begins to dissolve, so that a temperature range of solution heat treatment is defined as 1210° C. to 1350° C.

In the present invention, there are many cases wherein first ageing annealing treatment functions usually also as diffusion heat treatment of coating. For this reason, a temperature in the to first ageing annealing treatment is specified to 1100° C. to 1200° C. in the present invention with taking coating applicability into consideration. A more preferable first ageing annealing treatment may be carried out at 1150° C. temperature.

Additionally, in the present invention, when a heat treatment extending over multiple stages wherein temperature is allowed to change in cases of solution heat treatment and ageing annealing treatment is applied, nickel-base single-crystal superalloys having an excellent creep strength can be obtained.

Particularly, when a preliminary heat treatment is carried out at a lower temperature by 20° C. to 60° C. than that of the solution heat treatment, local dissolution due to abrupt temperature rise is prevented, whereby nickel-base single-crystal superalloys having an excellent creep strength can be obtained.

BRIEF DESCRIPTION OF THE DRAWINGS

The present invention will be explained in more detail in conjunction with appended drawings, wherein.

DETAILED DESCRIPTION OF THE PREFERRED EMBODIMENTS

Preferred embodiments of the present invention will be described specifically hereinafter in conjunction with the accompanying drawings including FIGS. 1 through 5 as well as TABLES I through VIII.

FIRST PREFERRED EMBODIMENT

Figure 1:
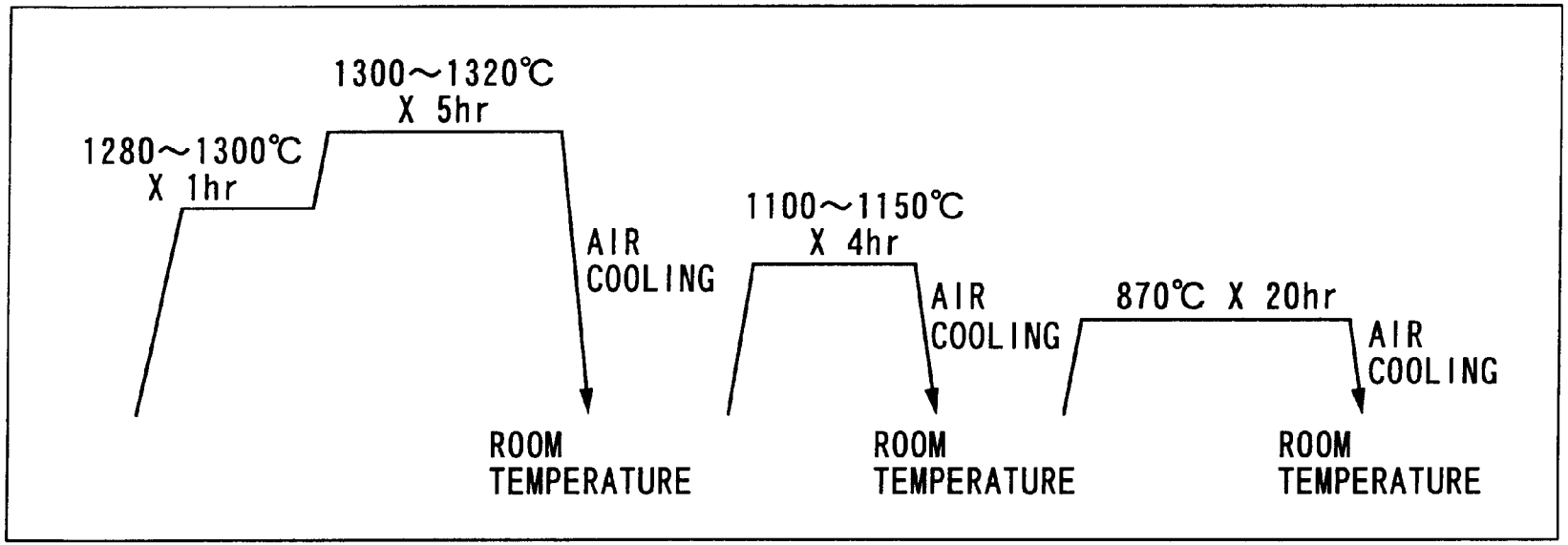
FIG. 1 is a diagram of a heat treatment sequence with respect to the examples and the comparative examples in the first embodiment of the present invention.
Figure 2:
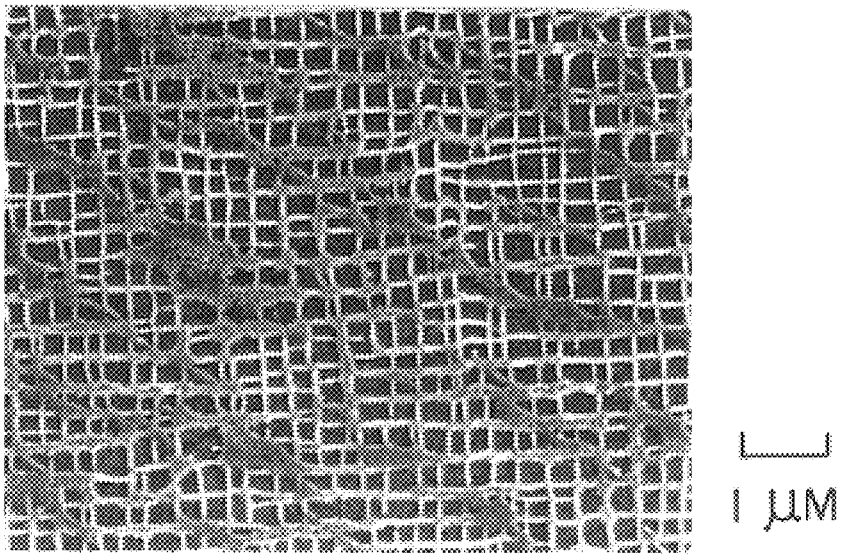
FIG. 2 is a photomicrograph showing an alloy structure after subjecting the alloy to creep test under the conditions of 1000° C. and 196 MPa in the examples of the first embodiment.
Figure 3:
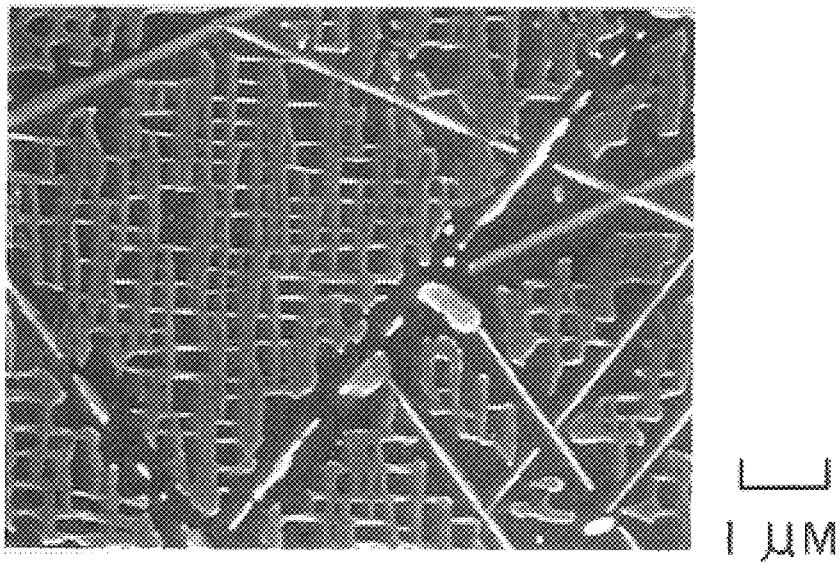
FIG. 3 is a photomicrograph showing an alloy structure after subjecting the alloy to creep test under the conditions of 1000° C. and 196 MPa in the comparative examples of the first embodiment.

FIGS. 1 to 3; Tables I to IV

In the present preferred embodiment, it was confirmed that nickel-base single-crystal superalloys each being within a range of alloy composition according to the present invention exhibited excellent creep strength, high-temperature corrosion resistance, and structural stability, respectively.

EXAMPLES

Table I

In the present examples, nickel-base single-crystal alloys were employed. These alloys have the composition in samples No.1 through No.9 shown in TABLE I. It's expressed as percentages of weight.

TABLE I

| | ALLOY COMPOSITION (weight %) Elements | | | | | | | | | |
|---|---|---|---|---|---|---|---|---|---|---|
| Sample | Co | Cr | Mo | W | Al | Ti | Ta | Re | Hf | Ni |
| Example | | | | | | | | | | |
| No.1 | 7.70 | 4.90 | 3.30 | 8.80 | 5.20 | 0.50 | 4.50 | 2.50 | 0.10 | Bal. |
| No.2 | 8.00 | 4.70 | 3.40 | 7.60 | 5.30 | 0.40 | 4.50 | 2.00 | 0.20 | Bal. |
| No.3 | 9.60 | 5.90 | 2.10 | 7.60 | 5.00 | 0.10 | 4.90 | 2.10 | 0.01 | Bal. |
| No.4 | 8.00 | 4.60 | 3.40 | 9.80 | 5.10 | 0.10 | 4.00 | 2.30 | 0.10 | Bal. |
| No.5 | 8.50 | 4.70 | 2.70 | 7.60 | 5.20 | 0.50 | 4.30 | 3.90 | 0.02 | Bal. |
| No.6 | 9.90 | 5.90 | 3.40 | 9.90 | 5.40 | 0.40 | 4.90 | 1.00 | 0.20 | Bal. |
| No.7 | 8.00 | 5.90 | 3.40 | 7.50 | 5.00 | 1.90 | 4.10 | 2.70 | 0.20 | Bal. |
| No.8 | 5.00 | 5.90 | 2.40 | 8.10 | 5.20 | 0.30 | 4.10 | 3.90 | 0.10 | Bal. |
| No.9 | 5.00 | 5.90 | 3.20 | 7.60 | 5.90 | 0.30 | 5.40 | 1.60 | 0.10 | Bal. |
| Comparative Example | | | | | | | | | | |
| No.10 | 8.00 | 6.10 | 1.90 | 5.00 | 6.20 | — | 7.20 | 5.10 | 0.20 | Bal. |
| No.11 | 9.80 | 11.90 | 8.10 | 7.80 | 5.30 | 2.40 | 4.20 | 3.00 | 0.10 | Bal. |
| No.12 | 4.20 | 2.00 | 1.80 | 7.40 | 3.20 | 0.10 | 3.40 | 0.50 | 0.20 | Bal. |
| No.13 | 4.30 | 2.90 | 1.90 | 3.00 | 2.10 | 0.40 | 3.20 | 1.80 | — | Bal. |
| No.14 | 11.50 | 13.60 | 2.10 | 8.30 | 5.20 | 1.60 | 4.30 | 3.20 | 0.20 | Bal. |
| No.15 | 4.80 | 8.20 | 4.30 | 8.10 | 7.20 | 2.40 | 5.80 | 3.20 | 0.10 | Bal. |
| Conventional Example (CMSX-4) | | | | | | | | | | |
| No.16 | 9.00 | 6.50 | 0.60 | 6.00 | 5.60 | 1.00 | 9.50 | 3.00 | 0.10 | Bal. |

As shown in TABLE I, the alloy consists of 5% to 10% cobalt, 4.7% to 6% chromium, more than 2.0% to less than 3.5% molybdenum, 7.5% to 10% tungsten, 5% to 6% aluminum, 0.1% to 2% titanium, 4% to 5.5% tantalum, 1% to 4% rhenium and 0.01% to 0.2% hafnium. And the balance is nickel and incidental impurities.

COMPARATIVE EXAMPLES

Table I

In the present comparative examples, nickel-base single-crystal alloys each having a composition of components within a range represented by any of sample No.10 through sample No.15 shown in TABLE I.

As shown in TABLE I, the alloys represented by sample No.10 through sample No.15 are the ones each having a composition of components being out of the range defined in the present invention.

CONVENTIONAL EXAMPLE

Table I

In the conventional example, CMSX-4 being second generation single-crystal alloy is used, and the composition of components of CMSX-4 corresponds to sample No.16 shown in TABLE I.

More specifically, an alloy corresponding to that of sample No.16 consists of 9.0% cobalt, 6.5% chromium, 0.6% molybdenum, 6.0% tungsten, 5.6% aluminum, 1.0% titanium, 6.5% tantalum, 3.0% rhenium and 0.1% hafnium. And the balance is nickel and incidental impurities.

Raw materials in each example were previously selected in a suitable ratio so as to obtain the composition shown in TABLE I, and each test piece with respect to the alloys having the composition of components shown in the examples, the comparative examples, and the conventional example, was prepared. The selected raw materials were refined by vacuum dissolution, and then, an ingot re-molted was prepared, and a melting stock having a dimension of around 100 mm diameter×1000 mm length was cast from the ingot. The resulting melting stock was divided into a required number of sections. Thereafter, a single-crystal alloy test piece of a round bar-shaped having a dimension of 9 mm diameter×100 mm length was fabricated from each sectioned melting stock in accordance with drawing method.

Each of the resulting test pieces was etched by the mixed solution consisting of hydrochloric acid and aqueous hydrogen peroxide. And it was confirmed that the whole test piece was single-crystalized and that the direction of growth in crystal had an angle of 10° or less with respect to the drawing direction by means of visual observation.

FIG. 1 is a diagram showing a heat treatment sequence with respect to the examples and the comparative examples.

As shown in FIG. 1, fifteen type alloys of sample No.1 through sample No.15 corresponding to the examples and the comparative examples, respectively, were subjected to solution heat treatment at a temperature of 1300° C. to 1320° C. within a temperature range extending from that equal to or higher than the dissolution temperature and that equal to or lower than the melting point of γ' in any of the respective alloys for 5 hours. Furthermore, a preliminary heat treatment was conducted for 1 hour within a temperature range extending from 1280° C. to 1300° C. being 20° C. lower than the solution heat treatment temperature prior to effecting the solution heat treatment in order to prevent local dissolution.

After the solution heat treatment, each test piece was air-cooled up to room temperature, the test piece thus air-cooled was subjected to first ageing annealing treatment directing to γ' deposition at a temperature within a range of from 1100° C. to 1150° C. for 4 hours, and second ageing annealing treatment directing to γ' stabilization was carried out at 780° C. for 20 hours.

After these heat treatments, a test piece for estimating corrosion/structural stability having 6 mm diameter×4.5 mm as well as a creep test piece having 4 mm parallel section×20 mm, and the overall length being 60 mm were prepared, respectively.

Creep rupture test, high-temperature corrosion resistance test, and high-temperature age test were carried out with respect to the test pieces thus prepared. In the creep rupture test, the test was conducted under the condition of 1100° C. temperature and 138 MPa stress in the atmosphere to determine rupture life. In the high-temperature corrosion resistance test, a test piece was immersed into a molten salt having a composition of 75%$Na_2So_4$+25%NaCl which had been heated at 900° C. for 20 hours, and then, the resulting test piece was descalted, whereby an amount of decrease in mass due to corrosion was determined. The resulting amount of decrease in mass was calculated in terms of amount of erosion due to corrosion. Furthermore, in the high-temperature age test, a test piece was kept at 1000° C. for 800 hours, and then, presence of deposition of TCP phase was examined to estimate structural stability of the alloy. The results obtained are shown in TABLES II through IV as well as FIGS. II and III, respectively.

Creep test results of the alloys in examples, comparative examples, and a conventional example are shown in TABLE II, respectively.

TABLE II

| Sample | | Creep Rupture Life (hr) | Elongation (%) | Drawing (%) |
|---|---|---|---|---|
| Example | No.1 | 378.2 | 23.1 | 48.6 |
| | No.2 | 331.3 | 27.1 | 41.9 |
| | No.3 | 318.5 | 28.4 | 44.4 |
| | No.4 | 309.2 | 24.2 | 58.1 |
| | No.5 | 317.4 | 28.3 | 53.3 |
| | No.6 | 302.9 | 22.4 | 48.9 |
| | No.7 | 244.1 | 23.1 | 39.1 |
| | No.8 | 295.4 | 24.2 | 32.4 |
| | No.9 | 356.4 | 23.2 | 47.2 |
| Comparative Example | No.10 | 42.6 | 16.4 | 31.2 |
| | No.11 | 70.8 | 6.9 | 11.8 |
| | No.12 | 65.3 | 24.2 | 48.1 |
| | No.13 | 56.7 | 28.1 | 51.2 |
| | No.14 | 79.1 | 9.1 | 11.5 |
| | No.15 | 64 | 7.4 | 12.3 |
| Conventional Example (CMSX-4) | No.16 | 42.6 | 35.4 | 34.5 |

As shown in TABLE II, creep rupture life determined under the condition of 1100° C. and 138 MPa became 244 to 378 hours in sample No.1 through No.9 corresponding to alloys each having the composition defined in the present invention, and these results exhibit better characteristics than that of CMSX-4.

On the other hand, in the alloys corresponding to sample No.10 to sample No.15 in the comparative examples, creep strength decreases, because of excessive addition of Al and Re. This is because elements for reinforcing solution such as Re, Cr, W and the like are separated out in a needle-like or a plate-like form, and creep characteristics are adversely affected thereby, when elements are added over solution limit of nickel matrix. Likewise, Cr and Ti were excessively added in the alloy of sample No.11 as well as Cr and Co were excessively added in the alloy of sample No.14. Thus these added elements exceeded solution limit in nickel matrix to separate out TCP phases of Re—W, Re—Mo, Re—Cr—W, α-W, α-Mo and the like, whereby values of creep rupture life were decreased. Moreover, since Ta was excessively added in also the alloy of sample No.15, creep rupture life decreased.

On one hand, when an amount of element added is less than that specified within a range of alloy composition in the present invention, reinforcement of γ' deposition or solution reinforcement of Re, Mo, W and the like do not act effectively, resulting in a creep strength equal to or less than that of a conventional alloy.

Results of high-temperature corrosion test with respect to the alloys in examples, comparative examples, and a conventional example are shown in TABLE III.

TABLE III

| Sample | | Eroded Amount due to Corrosion (mm) |
|---|---|---|
| Example | No.1 | 0.0009 |
| | No.2 | 0.0008 |
| | No.3 | 0.0004 |
| | No.4 | 0.0003 |
| | No.5 | 0.0002 |
| | No.6 | 0.0008 |
| | No.7 | 0.0002 |
| | No.8 | 0.0001 |
| | No.9 | 0.0009 |
| Comparative Example | No.10 | 0.0001 |
| | No.11 | 0.0001 |
| | No.12 | 4.1000 |
| | No.13 | 0.8000 |
| | No.14 | 0.0004 |
| | No.15 | 0.0004 |
| Conventional Example (CMSX-4) | No.16 | 0.2000 |

As shown in TABLE III, the alloys in the examples within a range of composition defined in the present invention exhibited good corrosion resistance. On the contrary, the alloys of sample No.12 and sample No.13 each containing 4.7% or less of Cr exhibited a remarkable eroded amount due to corrosion, that is, a worse result of high-temperature corrosion resistance than that of an alloy to which had been added 4.7% or higher Cr.

Results of test for estimating structural stability of the alloys in examples, comparative examples, and a conventional example are shown in TABLE IV.

FIG. 2 is a photomicrograph of an alloy structure after applying creep test under the condition of 1000° C. and 196 MPa with respect to an alloy having a composition of components in any of the examples.

FIG. 3 is a photomicrograph of an alloy structure after applying creep test under the condition of 1000° C. and 196

MPa with respect to an alloy having a composition of components in any of the comparative examples.

TABLE IV

| Sample | | Presence of Deposition of TCP Phase NO Deposition |
|---|---|---|
| Example | No.1 | NO Deposition |
| | No.2 | NO Deposition |
| | No.3 | NO Deposition |
| | No.4 | NO Deposition |
| | No.5 | NO Deposition |
| | No.6 | NO Deposition |
| | No.7 | NO Deposition |
| | No.8 | NO Deposition |
| | No.9 | NO Deposition |
| Comparative Example | No.10 | Deposition |
| | No.11 | Deposition |
| | No.12 | NO Deposition |
| | No.13 | NO Deposition |
| | No.14 | Deposition |
| | No.15 | Deposition |
| Conventional Example (CMSX-4) | No.16 | NO Deposition |

As shown in TABLE IV, it has been found that even if an alloy having a composition within a range of any example defined in the present invention is kept for 1000 hours, a good structure wherein only rectangular γ' phases are separated out in nickel matrix is observed in the resulting alloy as shown in FIG. 2, while plate-like or needle-like TCP phases are produced as shown typically in FIG. 3, so that structural stability becomes poor in an alloy in any of the comparative examples to which have been added excessively elements, that is, the composition is out of the range specified in the present invention.

In accordance with the first preferred embodiment, when an alloy composition is specified in the range of composition according to the present invention, a nickel-base single-crystal superalloys having excellent high-temperature strength, high-temperature corrosion resistance, and structural stability can be obtained.

SECOND PREFERRED EMBODIMENT

Figure 4:
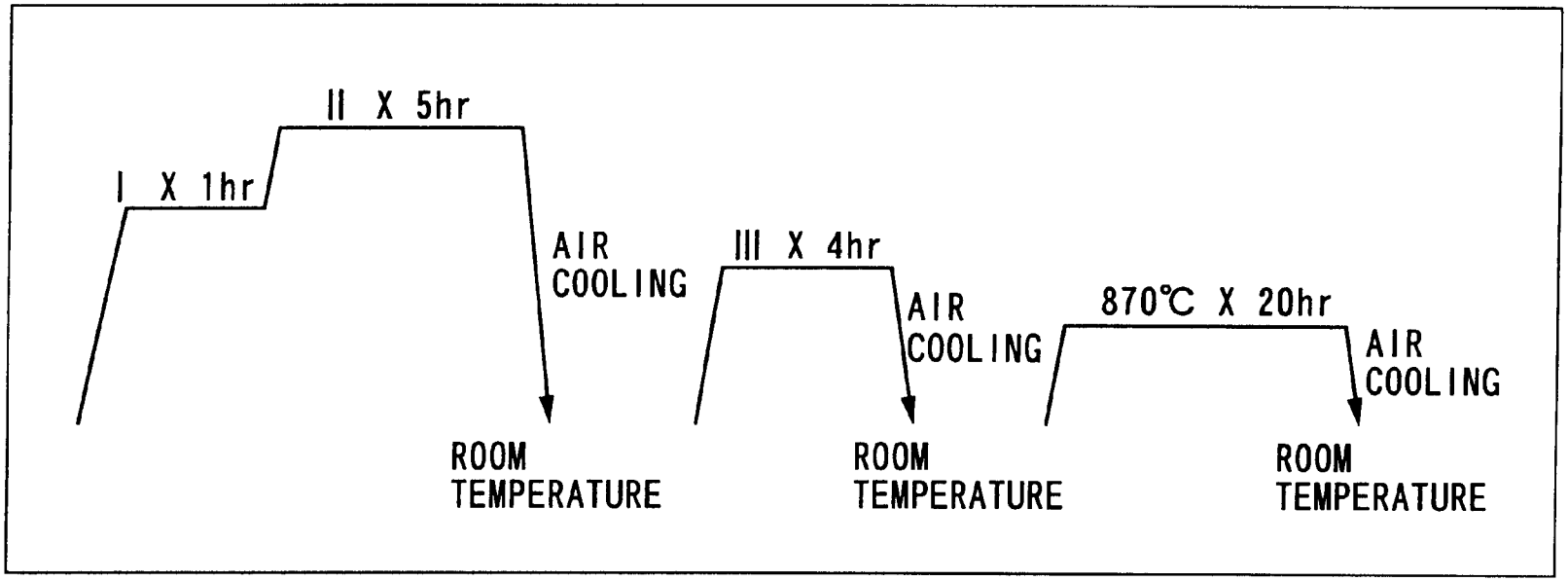
FIG. 4 is a diagram showing a heat treatment sequence in the case where heat-treating conditions are changed in the second embodiment of the present invention.

FIG. 4; Tables V to VII

In the second preferred embodiment, it was confirmed that a nickel-base single-crystal superalloy within a heat-treating range specified in the present invention had excellent creep strength.

aa melting stock having forty kilograms by weight was prepared to direct to obtain the alloy composition of sample No.1 shown in TABLE I. And a composition of the obtained alloy was analyzed. Results of its analysis are shown in TABLE V.

TABLE V

| | Elements (weight %) | | | | | | | | | |
|---|---|---|---|---|---|---|---|---|---|---|
| Melting stock | Co | Cr | Mo | W | Al | Ti | Ta | Re | Hf | Ni |
| | 7.8 | 5.0 | 3.4 | 8.7 | 5.2 | 0.5 | 4.4 | 2.4 | 0.1 | Bal. |

As shown in TABLE V, the resulting stock consists of, in percentages by weight, 7.8% cobalt, 5.0% chromium, 3.4% molybdenum, 8.7% tungsten, 5.2% aluminum, 0.5% titanium, 4.4% tantalum, 2.4% rhenium and 0.1% hafnium. And the balance is nickel and incidental impurities.

Then, a single-crystal round rod test piece having 9 mm diameter×100 mm length was fabricated from the resulting melting stock in accordance with drawing method.

The resulting test piece was etched by the mixed solution consisting of hydrochloric acid and aqueous hydrogen peroxide. And it was confirmed that the whole test piece was single-crystallized and that the direction of growth in crystal had an angle of 10° or less with respect to the drawing direction by means of visual observation.

EXAMPLES

FIG. 4; Table VI

In the present examples, heat treatment was conducted under the conditions of the temperature range defined in the present invention.

FIG. 4 is a diagram showing a heat treatment sequence in the case where heat-treating conditions are changed in the second preferred embodiment of the invention.

As shown in FIG. 4, preliminary heat treatment I, solution heat treatment II, and first ageing annealing treatment III being the heat-treating conditions in the preferred second embodiment were conducted in the temperature ranges specified in the present invention.

The solution heat treatment I resided in a temperature range of from 1210° C. to 1350° C., and the first ageing annealing treatment III resided in a temperature range of from 1100 to 1200° C. Furthermore, the preliminary heat treatment I was applied at a lower temperature by 20° C. to 60° C. than that of the solution heat treatment II prior to the solution heat treatment III. And, test pieces No.1 to No.7 were obtained in accordance with the heat-treating conditions shown in the following TABLE VI.

TABLE VI

| Sample | Preliminary Heat Treatment I | Solution Heat Treatment II | First Ageing Annealing Treatment III |
|---|---|---|---|
| Example | | | |
| No. 1 | 1300° C. | 1320° C. | 1150° C. |
| No. 2 | 1300° C. | 1320° C. | 1100° C. |
| No. 3 | 1300° C. | 1320° C. | 1180° C. |
| No. 4 | 1330° C. | 1350° C. | 1150° C. |
| No. 5 | 1330° C. | 1350° C. | 1100° C. |
| No. 6 | 1190° C. | 1210° C. | 1100° C. |
| No. 7 | 1190° C. | 1210° C. | 1150° C. |
| Comparative Example | | | |
| No. 8 | 1170° C. | 1190° C. | 1150° C. |
| No. 9 | 1170° C. | 1190° C. | 1100° C. |
| No. 10 | 1340° C. | 1360° C. | 1100° C. |
| No. 11 | 1340° C. | 1360° C. | 1150° C. |
| No. 12 | 1300° C. | 1320° C. | 900° C. |
| No. 13 | 1300° C. | 1320° C. | 1250° C. |

As shown in TABLE VI, the test pieces No.1 to No.7 were worked, respectively, into creep test pieces each having a dimension of 4 mm parallel section×20 mm, the overall length being 60 mm.

COMPARATIVE EXAMPLES

FIG. 4; Table VI

In the present comparative examples, the heat-treating conditions were out of the temperature ranges defined in the present invention. More specifically, test pieces No.8 to No.

13 were determined for the preliminary heat treatment I, the solution heat treatment II and the to first ageing annealing treatment III being the heat-treating conditions in the present comparative examples shown in TABLE VI.

After applying the respective heat treatments to the test pieces No.8 to No.13, they were worked, respectively, into creep test pieces each having a dimension of 4 mm parallel section×20 mm, the whole length being 60 mm.

Creep rupture test was conducted by the use of the creep test pieces No.1 to No.13. The creep rupture test was carried out in the atmosphere under the conditions of 1100° C. temperature and 138 MPa stress to determine rupture life. Results of the test are shown in TABLE VII.

TABLE VII

| Sample | | Creep Rupture Life (hr) |
|---|---|---|
| Example | No.1 | 360.3 |
| | No.2 | 252.4 |
| | No.3 | 353.1 |
| | No.4 | 180.1 |
| | No.5 | 162.1 |
| | No.6 | 148.7 |
| | No.7 | 156.8 |
| Comparative Example | No.8 | 78.4 |
| | No.9 | 76.0 |
| | No.10 | 27.3 |
| | No.11 | 32.0 |
| | No.12 | 121.0 |
| | No.13 | 118.9 |

As shown in TABLE VII, the test pieces No.1 through No.7 in the examples wherein the solution treatment was conducted at a temperature of from 1210° C. to 1320° C. exhibited better creep strengths than those of the test pieces No.8 through No.13 in the comparative examples. Particularly, when solution heat treatment was carried out at a temperature equal to or less than 1210° C., segregation of the elements in an alloy as well as dissolution of γ'-phase into nickel matrix are insufficient, so that the γ' could not take an effective form to elevate strength, whereby creep strength decreased. On the other hand, when a temperature of the solution heat treatment was 1350° C. or higher, γ-γ' eutectic crystal dissolved locally to make holes, and such holes became starting points of creep rupture, whereby creep strength deteriorated.

Furthermore, the test pieces No.1 to No.3 which were prepared at 1320° C. solution temperature and at a one-stage age temperature of from 1100° C. to 1180° C. exhibited particularly excellent creep rupture characteristics. However, the test piece No.12 prepared at 1320° C. solution temperature and 900° C. one-stage age temperature exhibited a small amount of γ' separated out. Moreover, the test piece No.13 prepared at 1320° C. solution temperature and 1250° C. one-stage age temperature produced bulky γ', so that creep strength decreased.

In accordance with the second preferred embodiment, when the temperature conditions in preliminary heat treatment, solution heat treatment, and ageing annealing treatment are specified in the range of the present invention, a nickel-base single-crystal superalloy having excellent creep strength can be obtained.

THIRD PREFERRED EMBODIMENT

FIG. 5; Table VIII

In the third preferred embodiment, it was confirmed that when temperature changes in accordance with multiple stages were applied to an alloy as a heat treatment, the resulting alloy exhibited an excellent creep strength even at a temperature of 900° C. or higher and in 200 MPa or less stress.

EXAMPLES

FIG. 5; Table VIII

In the present examples, a single-crystal round rod test piece having 9 mm diameter×100 mm length was fabricated from the melting stock prepared in the second preferred embodiment in accordance with drawing method. The resulting test piece was etched by the mixed solution consisting of hydrochloric acid and aqueous hydrogen peroxide. And it was confirmed that the whole test piece was single-crystallized and that the direction of growth in crystal had an angle of 10° or less with respect to the drawing direction by means of visual observation.

Thereafter, the test pieces were heat-treated in a vacuum furnace wherein heat-treating conditions are as described hereinafter. First, the vacuum furnace was evacuated up to $10^{-4}$ Torr, and then, the temperature therein was raised up to 1300° C. at a rate of 10° C./min. After the test pieces were maintained at 1300° C. for one hour, the temperature was raised up to 1320° C. at a rate of 10° C./min. Continuously, the test pieces were kept at 1320° C. for 5 hours, and then, argon gas fan cooling wherein argon gas is allowed to blow upon a test piece to carry out forced cooling was performed.

Then, the temperature was raised up to 1150° C. at a rate of 10° C./min., the test pieces were maintained at 1150° C. for 4 hours, and then, cooled up to room temperature by means of argon gas fan cooling. Thereafter, the temperature was raised up to 870° C. at a rate of 10° C./min., the test pieces were kept at 870° C. for 20 hours, and then, cooled to room temperature by means of argon gas fan cooling.

After the heat treatment, flanged creep test pieces each having a dimension of 4 mm parallel section diameter, 20 mm gauge length, 60 mm overall length were fabricated from four round rod test pieces.

Creep test had been made with respect to the test pieces of sample No.14 to sample No.17 prepared. As to creep test conditions, a test was implemented with respect to the test piece No.14 at 900° C. temperature and in 392 MPa stress, while a test was conducted with respect to the test piece No.15 at 1000° C. temperature and in 196 MPa stress. Furthermore, a creep test is performed with respect to the test piece No.16 at 1100° C. temperature and in 138 MPa stress as well as with respect to the test piece No.17 at 1100° C. temperature and in 96 MPa stress, respectively. Results of the test obtained are shown in TABLE VIII and FIG. 5.

TABLE VIII

| | Treating Condition | | | | |
|---|---|---|---|---|---|
| Test Piece | Temperature (° C.) | Stress (MPa) | Creep Rupture Life (hr) | Elongation (%) | Drawing (%) |
| No. 14 | 900 | 392 | 390 | 22.9 | 48.2 |
| No. 15 | 1000 | 196 | 660 | 25.8 | 43.2 |
| No. 16 | 1100 | 138 | 379 | 32.1 | 40.1 |
| No. 17 | 1100 | 96 | 2833 | 35.1 | 50.1 |

CONVENTIONAL EXAMPLE

FIG. 5

In the conventional example, data as to CMSX-4 being a conventional example was used for comparing the same with the test pieces of sample No.14 to sample No.17 in the present examples. As the data of CMSX-4, the values read from TABLE 4 and FIG. 12 described in "DS AND SX SUPERALLOYS FOR INDUSTRIAL GAS TURBINES"; G. L. Erickson and K. Harris: Materials for Advanced Power Engineering, 1994 were employed. The data was also described together with that of a comparative example in FIG. 5.

Figure 5:
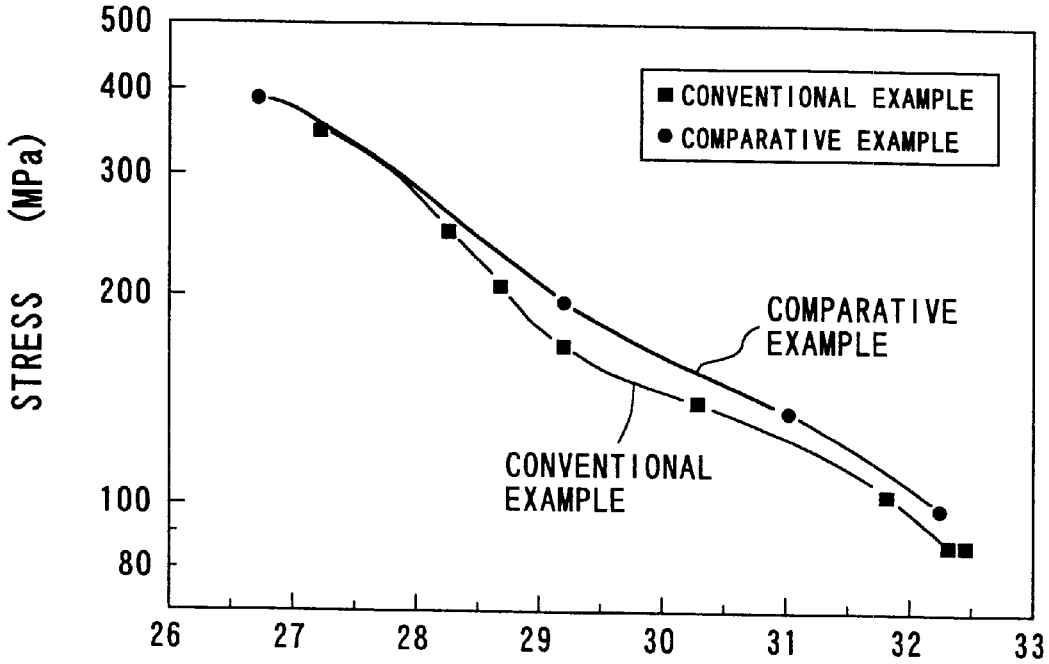
FIG. 5 is a graph of comparative Larson Miller stress-rupture test on the alloy of the comparative examples and CMSX-4 in the third embodiment.

FIG. 5 is a graphical representation wherein creep strength of the test pieces of sample No.14 to sample No.17 are compared with that of CMSX-4 in which results are expressed by abscissa of Larson-Miller parameter (LMP) being an parameter of temperature and time as well as ordinate of stress.

As shown in TABLE 8 and FIG. 5, creep rupture life is more improved in the test pieces of sample No.15 to sample No.17 each of treating conditions of which is such that a temperature is 900° C. or higher and a stress is within 200 MPa or less than that of the CMSX-4.

It was found that the test pieces according to the third preferred embodiment exhibited a substantially equivalent creep strength to that of the CMSX-4 under the conditions of 900° C. or lower temperature and 200 MPa or higher stress, while the former test pieces had a more improved creep rupture life than that of a second generation single-crystal alloy at a temperature of 900° C. or higher and in 200 MPa stress or less.

Accordingly, when heat treatment wherein temperature is applied in a multiple stage manner is practiced according to the third preferred embodiment, a nickel-base single crystal superalloy having excellent high-temperature strength, high-temperature corrosion resistance, and structural stability can be obtained.

As described above, according to a nickel-base single-crystal superalloy and a method for manufacturing the same of the present invention, excellent high-temperature strength, high-temperature corrosion resistance, and structural stability can be achieved. Further, according to gas turbine parts of the present invention, when the nickel-base single-crystal superalloy is applied to a gas turbine rotor blade, a gas turbine stator blade and the like, it can contribute remarkably to improvements in efficiency of gas turbine.

It will be appreciated by those of ordinary skill in the art that the present invention can be embodied in other specific forms without departing from the spirit or essential characteristics thereof.

The presently disclosed embodiments are therefore considered in all respects to be illustrative and not restrictive. The scope of the present invention is indicated by the appended claims rather than the foregoing description, and all changes that come within the meaning and range of equivalents thereof are intended to be embraced therein.

What is claimed is:

1. A nickel-base single-crystal superalloy, consisting of, in percentages by weight, 6% to 9% cobalt, 4.9% to 5.5% chromium, 2.5% to 3.5% molybdenum, 8% to 9.5% tungsten, 5.1% to 5.5% aluminum, 0.1% to 1% titanium, 4% to 5% tantalum, 2% to 3.5% rhenium, 0.01% to 0.2% hafnium, the balance being nickel and incidental impurities.

2. A method for manufacturing the nickel-base single-crystal superalloy of claim 1, wherein the method comprises the sequential steps of:

preparing raw materials containing nickel, cobalt, chromium, molybdenum, tungsten, aluminum, titanium, tantalum, rhenium and hafnium;

melting and cooling the raw materials to form a nickel-base single-crystal superalloy element material;

quenching the superalloy element material;

subjecting the quenched superalloy element material to solution heat treatment within a temperature range of from 1210° C. to 1350° C. under a condition of a vacuum or inert atmosphere;

quenching the superalloy element material;

subjecting the quenched superalloy element material to a first ageing annealing treatment within a temperature range of from 1100° C. to 1200° C.;

quenching the superalloy element material; and subjecting the quenched superalloy element material to a second ageing annealing treatment within a temperature range lower than that of the first ageing annealing treatment.

3. The method for manufacturing a nickel-base single-crystal superalloy according to claim 2, wherein the solution heat treatment is carried out for a period of time of up to 10 hours and the ageing annealing treatment is carried out for a period of time of up to 30 hours.

4. The method for manufacturing a nickel-base single-crystal superalloy as claimed in claim 2, wherein a preliminary heat treatment is carried out at a temperature by 20° C. to 60° C. lower than that of the solution heat treatment for up to 2 hours, and the preliminary heat treatment is prior to the solution heat treatment.

5. Gas turbine parts constituted by a material made from a nickel-base single-crystal superalloy consisting of, in percentages by weight, 6% to 9% cobalt, 4.9% to 5.5% chromium, 2.5% to 3.5% molybdenum, 8% to 9.5% tungsten, 5.1% to 5.5% aluminum, 0.1% to 1% titanium, 4% to 5% tantalum, 2% to 3.5% rhenium, 0.01% to 0.2% hafnium, the balance being nickel and incidental impurities.

6. Gas turbine parts prepared from the nickel-base single-crystal superalloy manufactured in accordance with the manufacturing method as claimed in claim 2.

* * * * *